US006553672B2

(12) United States Patent
Glesser et al.

(10) Patent No.: US 6,553,672 B2
(45) Date of Patent: Apr. 29, 2003

(54) FOLDING KNIFE WITH COMPRESSION LOCKING MECHANISM

(75) Inventors: Louis S. Glesser, Evergreen, CO (US); Peter H. Jhones, Wellington, CO (US); Vince Ford, Arvada, CO (US)

(73) Assignee: Spyderco, Inc., Golden, CO (US)

( * ) Notice: Subject to any disclaimer, the term of this patent is extended or adjusted under 35 U.S.C. 154(b) by 0 days.

(21) Appl. No.: 09/792,688

(22) Filed: Feb. 22, 2001

(65) Prior Publication Data

US 2002/0000042 A1 Jan. 3, 2002

Related U.S. Application Data

(60) Provisional application No. 60/184,220, filed on Feb. 23, 2000.

(51) Int. Cl.[7] ..... B26B 1/04
(52) U.S. Cl. ..... 30/161
(58) Field of Search ..... 30/160, 161

(56) References Cited

U.S. PATENT DOCUMENTS

| | | | | |
|---|---|---|---|---|
| 5,111,581 A | | 5/1992 | Collins | 30/161 |
| 5,615,484 A | | 4/1997 | Pittman | 30/161 |
| 5,685,079 A | | 11/1997 | Brothers et al. | 30/161 |
| 5,737,841 A | | 4/1998 | McHenry et al. | 30/161 |
| 6,154,965 A | * | 12/2000 | Sakai | 30/161 |
| 6,360,443 B1 | | 3/2002 | Remus | 30/158 |
| 6,363,615 B1 | | 4/2002 | Moser | 30/161 |
| 6,397,477 B1 | | 6/2002 | Collins | 30/161 |

OTHER PUBLICATIONS

Digital Photographs of various Folding Knife designs and components with locking mechanisms which were created by Mr. Melvin Pardue of Repton, Alabama. It is believed that these products were first sold publicly displayed between about 1994 and 1998.

* cited by examiner

*Primary Examiner*—Douglas D. Watts
(74) *Attorney, Agent, or Firm*—Sheridan Ross P.C.

(57) ABSTRACT

A folding knife locking mechanism is provided which prevents the inadvertent closure of a knife blade by utilizing a releasable tang which is compressed between the heel end of the folding knife blade and a stop pin.

21 Claims, 7 Drawing Sheets

FOLDING KNIFE WITH COMPRESSION LOCKING MECHANISM

This application claims priority of U.S. provisional patent application Ser. No. 60/184,220 having a filing date of Feb. 23, 2000, and is incorporated herein in its entirety by reference.

FIELD OF THE INVENTION

The present invention is related to cutting instruments, and more specifically folding knives with locking mechanisms to prevent the inadvertent closure of a knife blade associated with the folding knife.

BACKGROUND OF THE INVENTION

Cutting instruments have been used for centuries by craftsmen, hunters, and others requiring a sharp cutting instrument. More recently, fixed length knives have been replaced with popular folding knives which generally have two positions. In a first extended position of use, the folding knife cutting blade is extended to expose the blade cutting edge and permit cutting therein. In a second closed position, the cutting edge of the blade is stored within a cavity in the handle portion of the knife, thus preventing the blade from being exposed and providing a cutting instrument which is much shorter in length than a typical fixed blade knife. Although these types of knives are extremely convenient, they can potentially become dangerous if the cutting blade does not have a locking mechanism to securely keep the knife blade in the first extended position of use. Likewise, it is often convenient to have a locking mechanism or some form of frictional ball detente apparatus to prevent the knife from inadvertently opening when the knife blade is in the second closed position.

Numerous attempts have been made to provide locking mechanisms which prevent a knife blade from inadvertently opening, closing, or both. One of the most commonly known locking mechanisms is a "back lock." The back lock uses a longitudinal length of rigid material, most commonly stainless steel, which pivots about a pivot point near the forward portion of the back lock. By applying pressure to a rearward portion of the locking mechanism, the locking mechanism rotates about the pivot point and releases a tang engagement mechanism from the heel portion of the knife blade. As the heel portion is released, the knife blade is released from the locking mechanism and is allowed to rotate from the first extended position to the second closed position. Although convenient to use, the back lock is not particularly strong and has a tendency to fail when excessive pressure is applied to the upper edge of the knife blade.

Another type of locking mechanism commonly used for folding knives is generally referred to as a "liner lock". A liner lock generally comprises a metallic leaf spring which is biased and positioned within the cavity of a knife handle and interconnected to one of the scales which comprises the knife handle. Upon opening of the knife blade to a first extended position of use, the forward or tang end of the leaf spring extends outwardly from the scale and behind the heel portion of the knife blade, thus preventing the knife blade from being closed without pushing the leaf spring liner lock to the side of the heel end of the knife blade, thus allowing rotation of the knife blade to the second closed position. Although simplistic in design, liner locks can potentially fail if excessive force is applied to the upper edge of the knife blade. During failure, the liner lock has a tendency to bow or otherwise deform, due to the extended length of the liner lock and the thin nature of the material required to fit within the knife handle cavity.

Although there are other types of locking mechanisms used to prevent the inadvertent closure of a folding knife blade, none are simplistic to use, inexpensive to manufacture and are essentially fail-proof. Thus, there is a need for a type of folding knife locking mechanism which is simplistic to use, inexpensive to manufacture, and provides substantial strength to prevent any inadvertent failure.

SUMMARY OF THE INVENTION

It is thus an object of the present invention to provide a folding knife locking mechanism which is substantially non-defeatable when pressure is applied to the back edge of the knife blade when the blade is in an extended position of use. It is a further object of the present invention that the folding knife locking mechanism be designed to use a minimum number of components, thus making the locking mechanism inexpensive to manufacture, simplistic in design, and encompassing a variety of different embodiments for use with a number of different folding knife designs.

It is a further object of the present invention to provide a locking mechanism which utilizes a compressive force generated over a very short distance between the blade stop pin and the heel end of the blade. This geometric configuration substantially prevents the locking mechanism from failing during use.

Thus, in one aspect of the present invention, a locking mechanism is provided which positions a tang between the stop pin of the knife handle and anvil portion of the heel end of the knife blade. When a force is applied to the upper edge of the knife blade, the tang of the knife locking mechanism is compressed between the anvil end of the heel end of the knife blade and the stop pin. This unique positioning of the tang allows the locking mechanism to withstand substantial forces.

Thus, in one particular aspect or embodiment of the present invention, a folding knife with a compression locking mechanism is provided which generally comprises:

- a handle having a front end, a rear end and a cavity defined therebetween;
- a knife blade having a front end, a heel end with an anvil, a cutting edge and an upper edge, said heel end rotatably interconnected to said front end of said handle wherein said knife blade travels between a first extended position of use and a second closed position with said knife blade cutting edge positioned within said handle cavity;
- a stop pin positioned within an upper edge of said handle cavity for engaging an upper portion of said heel end of said blade when said knife blade is in said first extended position of use;
- a locking mechanism positioned proximate to said handle cavity, said locking mechanism comprising a tang releasably positioned between said anvil of said blade and said stop pin when said knife blade is in said first extended position of use, wherein when pressure is applied downward on said upper edge of said knife blade, said tang is compressed between said blade anvil and said stop pin to prevent inadvertent closure of said knife blade.

DETAILED DESCRIPTION

Figure 1:
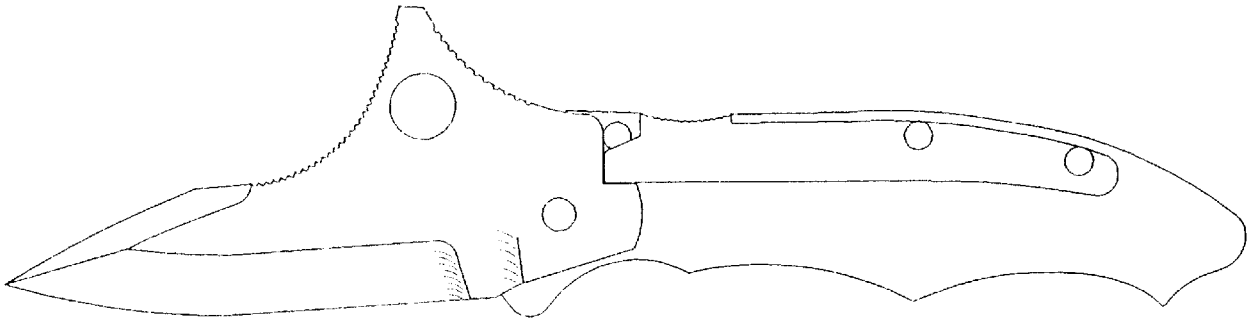
FIG. 1 is a front elevation view of a folding knife with a compression locking mechanism, the front scale of the handle being removed for clarity.

Referring now to the drawings, FIG. 1 represents one particular embodiment of the present invention and generally depicts a folding knife in a first extended position of use with the knife blade extended for use. In general, the folding knife 2 comprises a blade 4 rotatably interconnected to a handle 14 by means of a rotation pin 28 that extends through an aperture in the knife blade 4. The folding knife 2 is thus able to be used with the blade 4 in a first extended position of use as shown, and subsequently closed to a second position of non-use wherein the blade cutting edge 6 is positioned within the knife handle 14. The knife handle is generally comprised of a rear scale 16 and a front scale 18 which defines a cavity 58 for receiving the knife blade 4. A stop pin 12 is typically interconnected to the handle 14 near the upper edge and extends within the cavity 58. The stop pin 12 is typically provided to prevent the knife blade 4 from overtraveling when the blade is in a first extended position of use and force is applied to the cutting edge 6 of the blade 4. The knife blade 4 is generally comprised of a blade cutting edge 6, a blade upper edge 8, and a blade heel end 40 which further includes a blade anvil 20.

In one embodiment of the present invention, a locking mechanism 22 as seen in FIG. 1 is provided to secure the knife blade 4 in a first extended position of use. Generally, the locking mechanism comprises a locking mechanism tang 24 positioned at the forward end of the locking mechanism 22, and which is interconnected to either the rear scale 16 or front scale 18 by means of one or more attachment pins 30. Alternatively, the locking mechanism 22 can be interconnected to the knife handle by flues, adhesives or epoxies. The upper portion of the locking mechanism 22 comprises a thumb ramp 26 which is used to contact a user's thumb to engage and disengage the locking mechanism tang 24.

As seen in FIG. 1, the locking mechanism 22 works by the tang 24 being positioned between the blade anvil 20 and the stop pin 12 when the blade 4 is in a first extended position of use. Thus, when a force is provided downward on the blade upper edge 8, the tang 24 of the locking mechanism is compressed between the stop pin 12 and the blade anvil 20. This positioning of the tang 24 causes a compressive force between the stop pin 12 and anvil 20 when a force is applied to the upper end of the blade, and thus prevents the knife blade from rotating downward and potentially cutting a user's fingers. With this improved design, the overall strength of the knife locking mechanism is dictated by the size, i.e. width and/or height of the locking mechanism tang 24, and which can inherently be made to withstand substantially forces which are not possible with conventional folding knife locking mechanisms.

The locking mechanism 22 is generally comprised of a metallic material such as stainless steel. However, other materials resistant to compressive forces could be used for the same purpose. To disengage the tang 24 from between the stop pin 12 and the anvil 20, the locking mechanism 22 is pushed in a normal direction toward the adjacent scale by means of providing a lateral pressure to the thumb ramp 26. This removes the position of the tang 24 from between the stop pin 12 and anvil 20. As stated before, the locking mechanism could be provided adjacent either the front scale 18 or the rear scale 16 depending on the preference of the manufacturer and/or user.

Figure 2:
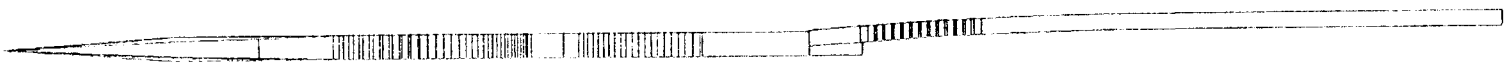
FIG. 2 is a top plan view of the folding knife of FIG. 1 with the stop pin removed for clarity in the upper drawing.
Figure 2:
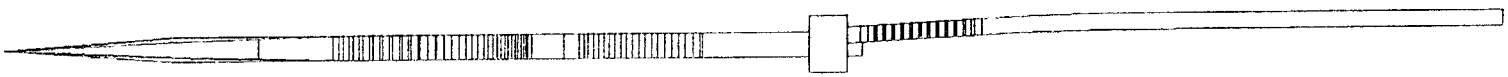

Referring now to FIG. 2, two top plan views are shown which more clearly identify the locking mechanism 22, the blade upper edge 8, and more specifically the locking mechanism tang 24 engaged to the blade anvil 20. The upper drawing of FIG. 2 shows the positioning of the tang 24 and the blade anvil 20 with the stop pin 12 removed for clarity. As seen in both FIG. 1 and the lower drawing in FIG. 2, the stop pin 12 is generally positioned directly above the tang 24, and thus provides the necessary obstacle to prevent the tang 24 from being driven upward when a significant force is applied to the blade upper edge 8. Alternatively, the stop pin could be an extension of the locking mechanism prevent overtravel by the knife blade 4.

Figure 3:
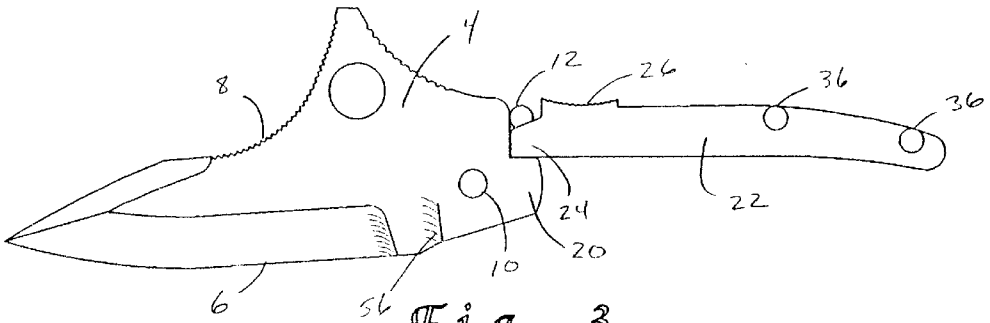
FIG. 3 is a front elevation view of the folding knife of FIG. 1 with both the front and the rear scale removed for clarity.

Referring now to FIG. 3, the folding knife of FIG. 1 is shown with the rear scale 16 removed for clarity. In this particular drawing, the locking mechanism 22 can be clearly shown engaged to the knife blade anvil 20. In an additional feature shown in FIG. 3, a blade lock detente 56 is provided in the blade heel end 40 which allows the folding knife blade to be in a closed position without inadvertently opening by means of the resistance provided by the locking mechanism 22 being engaged with the lock detente 56. Alternatively, a ball detente type of mechanism could be used for the same purpose. Thus, the locking mechanism 22 can be used both to prevent the knife blade 4 from being inadvertently closed when in a first extended position of use as shown in FIG. 3, and also from being opened when in a closed position as shown in FIGS. 4, 5 and 6.

Figure 4:
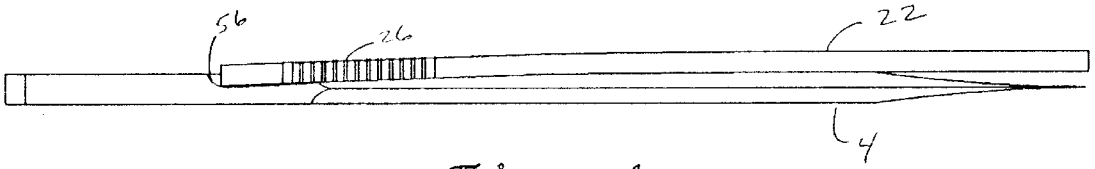
FIG. 4 is a top plan view of the folding knife of FIG. 3 with the knife blade in a closed position.
Figure 5:
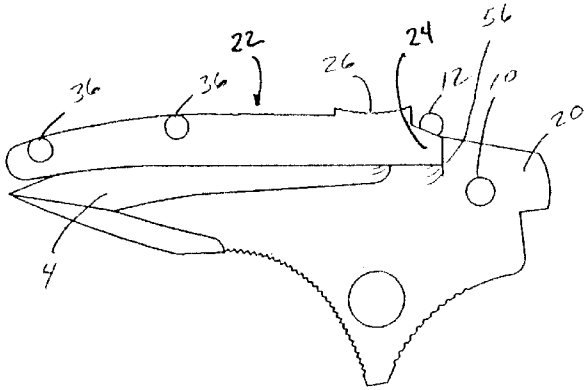
FIG. 5 is a rear elevation view of the knife in FIG. 4.

More specifically, and as seen in FIGS. 4–5, when the knife blade 4 is in a closed position of use, the forward end of the tang 24 becomes engaged with the blade lock detente 56 which is generally a slot or notch provided in the blade heel end 40. The resistance provided by the biasing of the compression locking mechanism 22 thus holds the blade 4 in a closed position until a slight pressure is applied downward on the knife blade 4, and thus pulling the blade away from the locking mechanism 22.

Figure 6:
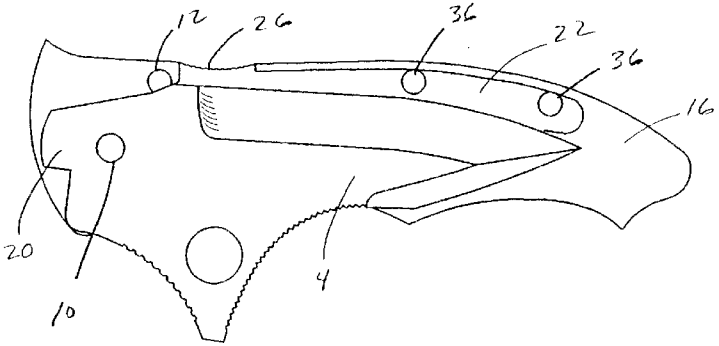
FIG. 6 is a front elevation view of the knife in FIG. 4.

Referring now to FIGS. 5–6, FIG. 6 is a front elevation view of the knife shown in FIG. 3 with the blade in a closed position, while FIG. 5 is a rear elevation view of the same embodiment of the present invention with the rear scale 16 removed for clarity. As seen in FIG. 5, the blade lock detente 56 is shown engaged with the compression lock tang 24 which holds the blade 4 in the closed position. Thus, when the knife blade 4 is pulled downward and away from the locking mechanism 22, a restrictive force between the locking mechanism 22 and the blade lock detente 56 is provided until the locking mechanism is pushed to the side of the blade heel end 40.

Figure 7:
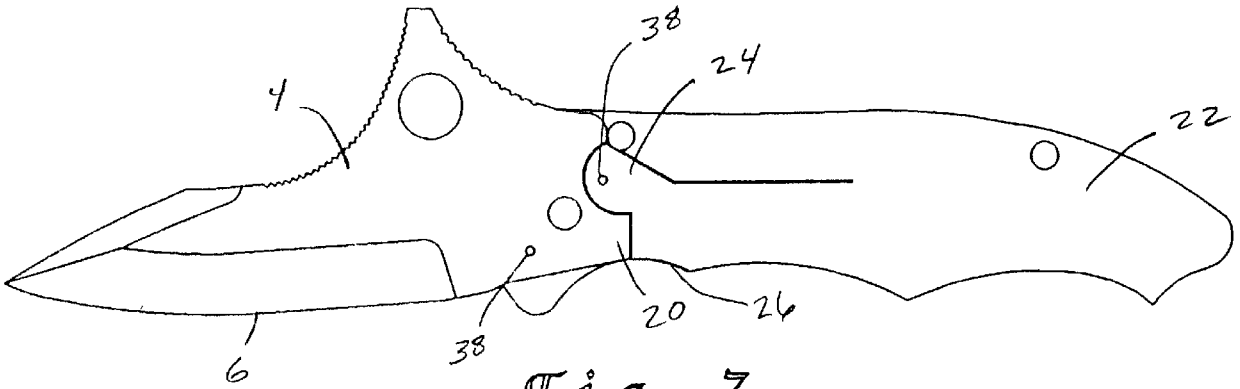
FIG. 7 is a front elevation view of a folding knife with an alternative embodiment of the compression locking mechanism.
Figure 8:
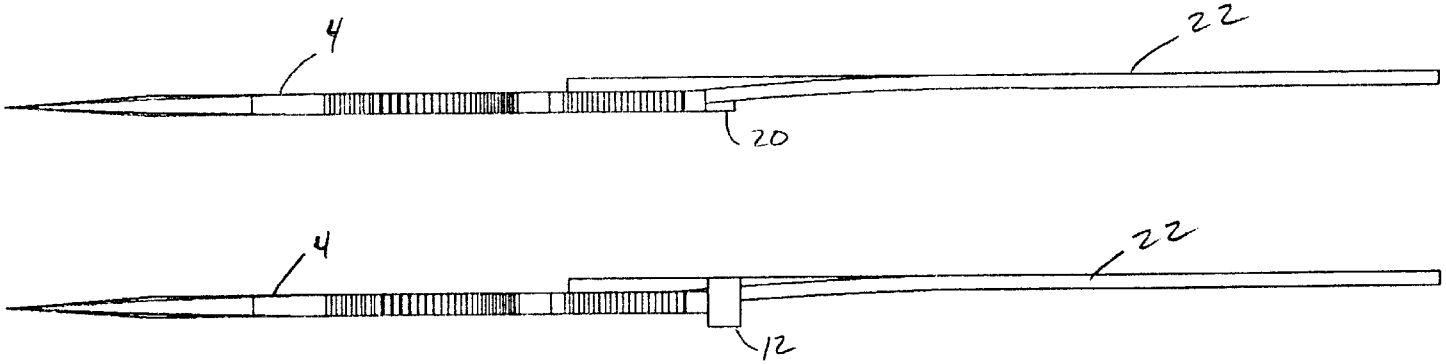
FIG. 8 is a top plan view of the knife shown in FIG. 7 with the stop pin removed for illustration purposes in the upper drawing.
Figure 9:
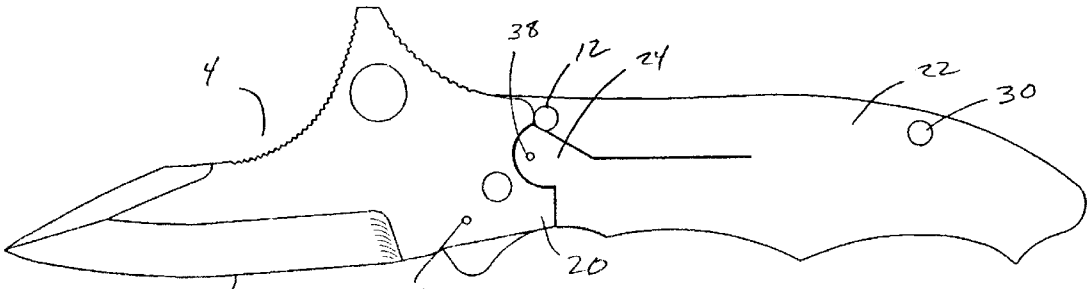
FIG. 9 is a front elevation view of a folding knife with the compression locking mechanism having a shape essentially the same as a knife handle, and with the blade shown in an extended position of use and both the front scale and rear scale removed for clarity.

Referring now to FIGS. 7 and 8, an alternative embodiment of the present invention is provided. In this particular design, the locking tang 24 has a slightly arcuate shape on a forward end, and has the thumb ramp 26 positioned on the lower end of the knife handle 14 as opposed to the upper end as shown in FIG. 1. Furthermore, the compression locking mechanism 22 and associated locking tang 24 comprises one of the scales of the knife handle 14. Thus, the compression locking mechanism 22 is integrally interconnected to the handle, and thus eliminates the necessity to manufacture and assemble an independent locking mechanism which is interconnected to one of the scales of the handle 14.

To release the tang 24 from the blade anvil 20 of the knife blade, the thumb ramp 26 is moved outward to allow the tang 24 to disengage from the blade heel end 40, and thus permit the knife to rotate from a first extended position of use as shown to a second closed position. As additionally seen in FIG. 7, a more typical type of ball detente 38 is provided which holds the knife blade 4 in the second closed position of use until the ball portion of the detente 38 is released from the female portion of the ball detente 38 which is shown on the heel end of the knife blade 4. As appreciated by one skilled in the art, the ball portion of the detente 38 may be provided on the heel portion of the blade, with the female portion of the ball detente provided in the tang portion of the compression lock. Referring now to FIG. 8, a top plan view is provided of the knife of FIG. 7 and showing the tang 24 engaged to the blade anvil 20. In the upper view of FIG. 8, the stop pin 12 is removed for clarity purposes, whereas in the bottom view the stop pin is shown.

Figure 10:
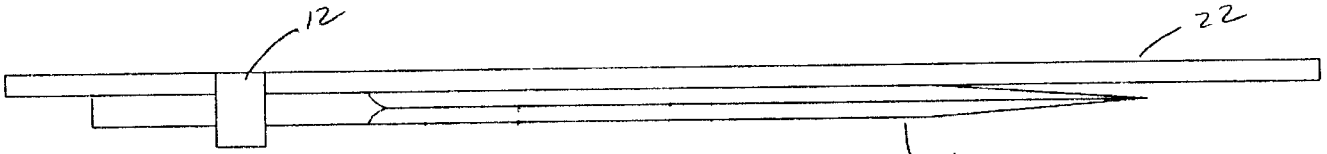
FIG. 10 is a top plan view of the knife of FIG. 9 with the blade in a closed position.
Figure 11:
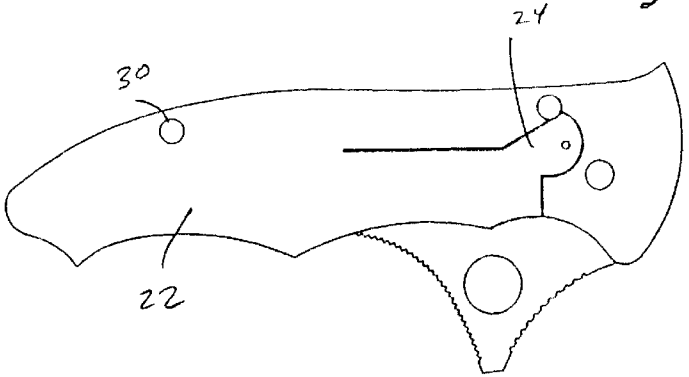
FIG. 11 is a rear elevation view of the knife of FIG. 10.
Figure 12:
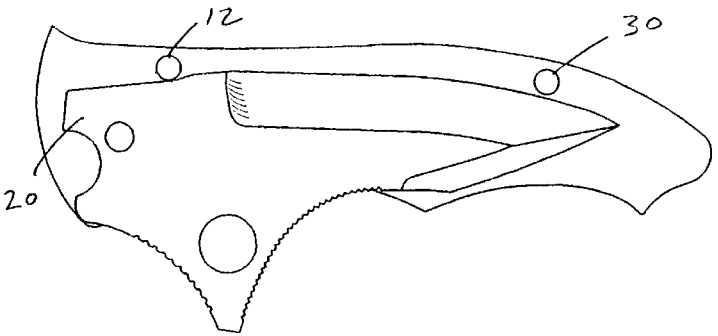
FIG. 12 is a front elevation view of the knife in FIG. 10.

Referring now to FIGS. 9–12, the invention of FIG. 8 is shown however the compression locking mechanism 22 is shown having a shape which is similar to the shape of the handle 14. Thus, in this embodiment, no additional handle piece, i.e., front scale 18 and rear scale 16, would be required to provide a functional folding knife with a compression locking mechanism. However, more typically various laminated or ornamental types of handle scales would be utilized by gluing and/or attaching the handle portion to the blade locking mechanism 22. In all other respects, the locking mechanism 22 and associated tang 24 are used in the same way as the compression locking mechanism 22 shown in the earlier drawings. FIG. 10 represents a top plan view of the invention shown in FIG. 10, while FIG. 11 is a rear elevation view with the knife blade 4 in a closed position, while FIG. 12 is a front elevation view of the invention shown in FIG. 9 with the blade 4 in a closed position.

Figure 13:
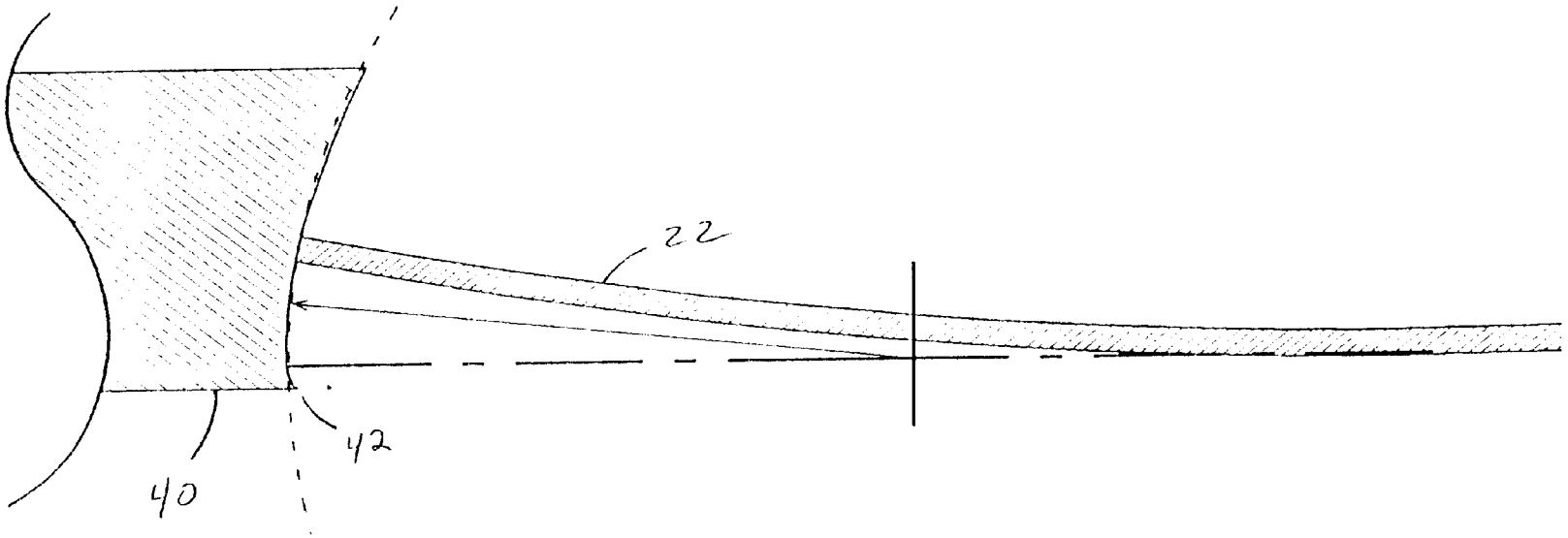
FIG. 13 is a top plan view of a liner lock knife locking mechanism shown in contact with the heel end of a knife blade.

Referring now to FIG. 13, this drawing depicts a top elevation view of a novel type of "liner lock" locking mechanism. As seen in this particular drawing, the liner lock 22 engages the blade heel end 40 to prevent the blade 4 from closing. However, there is one novel feature that is "progressive" liner lock that is not seen in the prior art. More specifically, there is a radius point of the blade heel end 42 which serves to prevent the locking mechanism 22 from inadvertently sliding and moving beyond the blade heel end 40. Although subtle, this "arcuate" curved portion of the liner lock is a very important feature of the radius point 42 of the blade heel end 40 is critical to prevent the locking mechanism 22 from inadvertently disengaging from the blade heel end 40.

Figure 14:
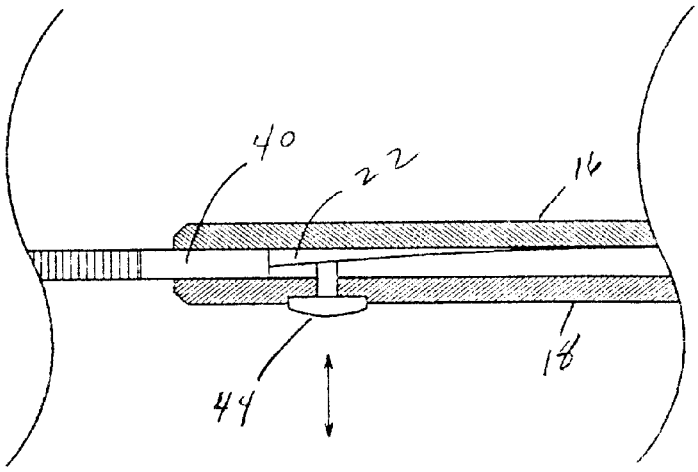
FIG. 14 is a top plan view of an alternative push button mechanism used for releasing the folding knife compression locking mechanism.

FIG. 14 is a top elevation view of an alternative release mechanism used in conjunction with the locking mechanism 22 of the present invention. More specifically, a lock push button 44 is provided which engages the lateral surface of the locking mechanism 22. When the blade 4 is desired to be released from the first extended position of use, pressure is merely provided to the push button 44 which engages the lateral side of the locking mechanism 22, and pushes the tang 24 to the side of the blade and thus allowing the blade to rotate downward. The lock push button 44 would typically be positioned in the middle of the knife handle 14 opposite the locking 24, although it is contemplated that other positions would be equally effective.

Figure 15:
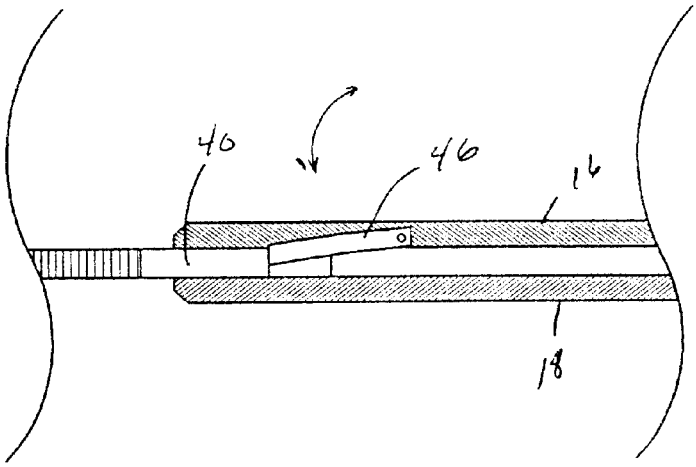
FIG. 15 is a top plan view of an alternative compression lock swivel release mechanism used for releasing the locking mechanism of the folding knife.

As shown in FIG. 15, an alternative embodiment of the present invention is provided. More specifically, a lock swivel release 46 is provided which has a shortened locking mechanism 22, but still incorporates the locking tang 24 which engages the blade anvil 20. To disengage the locking mechanism 22 from the blade heel end 40, an outward pressure is provided to the upper portion of the lock swivel release 46 which disengages the tang 24 from the blade anvil 20.

Figure 16:
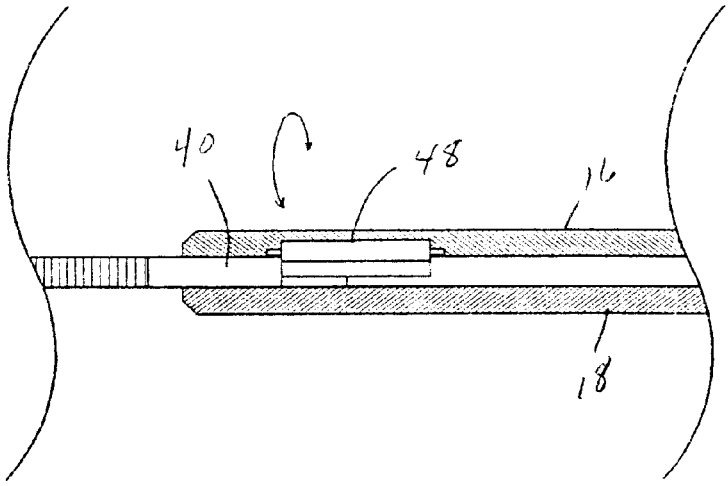
FIG. 16 is a top plan view of an alternative rotating lock release mechanism for releasing the compression locking device.

Referring now to FIG. 16, another alternative embodiment of the present invention is shown. More specifically, a rotating lock mechanism 48 is provided which allows the tang to swivel in and out between the blade anvil 20 and the stop pin 12. Thus as depicted by the arrow in this particular embodiment which identifies the respective direction of movement, when thumb pressure is applied to any part of the upper portion of the rotating lock mechanism 48 in a direction substantially normal to the longitudinal length of the handle, the tang 24 will become disengaged from the blade anvil 20.

Figure 17:
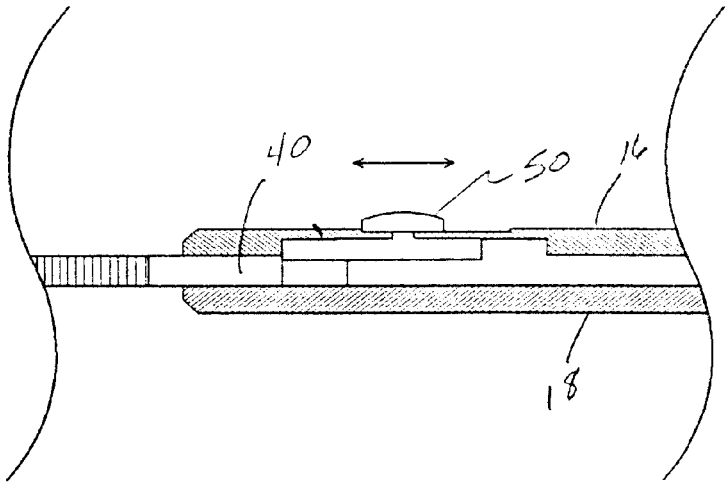
FIG. 17 is a top plan view of an alternative sliding release mechanism used to release the compression locking mechanism of the present invention.

Referring now to FIG. 17, yet another alternative embodiment of the present locking mechanism is shown. More specifically a sliding button release 50 is shown which allows the locking mechanism tang 24 to be slidingly engaged between the blade anvil 20 and the stop pin 12. Thus in this particular embodiment, to disengage the locking mechanism from the blade 4, the sliding release 50 is drawn rearward away from the knife blade 4 which removes the locking tang 24 from between the stop pin 12 and the blade anvil 20.

To provide further clarity to the detailed description provided herein in the associated drawings, the following list of components and associated numbering are provided as follows:

| Component No. | Component |
|---|---|
| 02 | Folding Knife |
| 04 | Blade |

-continued

| Component No. | Component |
|---|---|
| 06 | Blade Cutting Edge |
| 08 | Blade Upper Edge |
| 10 | Blade Aperture |
| 12 | Stop Pin |
| 14 | Handle |
| 16 | Rear Scale |
| 18 | Front Scale |
| 20 | Blade Anvil |
| 22 | Locking Mechanism |
| 24 | Locking Mechanism Tang |
| 26 | Thumb Ramp |
| 28 | Rotation Pin |
| 30 | Lock Attachment Pin |
| 32 | Handle Upper Edge |
| 34 | Handle Lower Edge |
| 36 | Locking Mechanism Aperture |
| 38 | Ball Detente |
| 40 | Blade Heel End |
| 42 | Radius Point Of Blade Heel End |
| 44 | Lock Push Button |
| 46 | Lock Swivel Release |
| 48 | Rotating Lock Mechanism |
| 50 | Sliding Button Release |
| 56 | Blade Lock Detente |
| 58 | Handle Cavity |

The foregoing description of the present invention has been presented for illustration and description purposes. However, the description is not intended to limit the invention to only the form as disclosed herein. Consequently, variations and modifications commensurate with the above teachings and skill and knowledge of the relevant art are within the scope of the present invention. The embodiments described herein above are further intended to explain best modes of practicing the invention and to enable others skilled in the art to utilize the invention in such a manner, or include other embodiments with various modifications as required by the particular application(s) or use(s) of the present invention. Thus, it is intended that the appended claims be construed to include alternative embodiments to the extent permitted by the prior art.

What is claimed is:

1. A folding knife with compression locking mechanism, comprising:

a handle having a front end, a rear end and a cavity defined therebetween;

a knife blade having a front end, a heel end with an anvil, a cutting edge and an upper edge, said heel end rotatably interconnected to said front end of said handle, wherein said knife blade travels between a first extended position of use and a second closed position wherein said knife blade cutting edge is positioned substantially within said handle cavity;

a stop pin interconnected to said handle proximate to an upper edge of said handle for engaging said heel end of said blade when said blade is in said first extended position of use; and a locking mechanism interconnected to said knife handle and operably positioned within said handle cavity, said locking mechanism comprising a releasable tang positioned directly between said anvil of said blade and said stop pin when said knife blade is in said first extended position of use, and traveling in a direction substantially perpendicular to a longitudinal axis of the handle, wherein when pressure is applied downward on said upper edge of said blade, said releasable tang is compressed between said blade anvil and said stop pin to prevent closure of said knife blade.

2. The folding knife of claim 1, wherein said knife handle comprises a first scale and an opposing second scale.

3. The folding knife of claim 1 wherein said releasable tang is biased to prevent closure of said knife blade when said knife blade is in said first position of use and may be selectively released to allow rotation of said knife blade to said second closed position.

4. The folding knife of claim 3, wherein said releasable tang is biased with a leaf spring which is integral to said locking mechanism.

5. The folding knife of claim 3, further comprising a ball detente positioned on said heel end of said knife blade and in operable contact with said locking mechanism, wherein said knife blade is impeded from opening when said knife blade is in said closed position.

6. The folding knife of claim 3, wherein said releasable tang is disengaged during closing of said knife blade by applying a force on said releasable tang in a direction which is substantially normal to a longitudinal axis of said handle.

7. The folding knife of claim 1, wherein said releasable tang is positioned proximate to an upper edge of said handle.

8. The folding knife of claim 1, wherein said locking mechanism has a thumb notch positioned along an upper edge of said handle, wherein said releasable tang can be disengaged from said blade anvil by a force being applied to said thumb notch.

9. The folding knife of claim 1, further comprising a lever to disengage said releasable tang from said blade anvil to allow said blade to travel to a second closed position.

10. The folding knife of claim 1, further comprising a push button to disengage said releasable tang from said blade anvil and allow said blade to travel to said second closed position.

11. The folding knife of claim 1, further comprising a sliding button to disengage said releasable tang from said blade anvil and allow said blade to travel to said second closed position.

12. A folding knife with compression locking mechanism, comprising:

a handle having a front end, a rear end and a cavity defined therebetween;

a knife blade having a front end, a heel end with an anvil, a cutting edge and an upper edge, said heel end rotatably interconnected to said front end of said handle, wherein said knife blade travels between a first extended position of use and a second closed position with said knife blade cutting edge positioned within said handle cavity;

a stop pin positioned within a forward end of said handle cavity for engaging said heel end of said blade to prevent over travel when said knife blade is in said first extended position of use; and a locking mechanism positioned within said forward end of said handle cavity and operably interconnected on at least a first end to said handle, said locking mechanism comprising a releasable tang positioned directly between said anvil of said blade and said stop pin when said knife blade is in said first extended position of use and traveling in a direction substantially perpendicular to a longitudinal axis of said handle, wherein when pressure is applied downward on said upper edge of said blade, said releasable tang is compressed between said blade anvil and said stop pin to prevent closure of said knife blade.

13. The folding knife of claim 12, wherein said locking mechanism is comprised of a metallic material.

14. The folding knife of claim 12, further comprising a thumb ramp interconnected to said locking mechanism and positioned along an upper edge of said knife handle, wherein a user's thumb may operatively engage said thumb ramp to release said locking mechanism.

15. The locking mechanism of claim 12, wherein said locking mechanism further comprises a ball detente interconnected thereto for releasably engaging said heel end of said knife blade to prevent inadvertent opening of said knife blade.

16. The folding knife of claim 12, wherein said releasable tang is positioned between said anvil of said blade and said stop pin when said blade is in said first position of use, and may be selectably released to allow closure of said knife blade.

17. A method for preventing the inadvertent closure of a folding knife blade, comprising:

providing a folding knife having a handle, a blade having a pointed end and a heel end, said heel end rotatably interconnected to a front end of said handle, said handle further comprising a cavity for receiving a cutting edge of said blade and a stop pin positioned proximate to an upper edge of said handle to engage said heel end of said blade when said blade is in an extended position of use;

providing a blade locking mechanism operably interconnected on at least a first end to said handle and having a releasable tang positioned between an anvil on said heel end of said knife blade and said stop pin when said knife blade is in said first extended position of use said releasable tang traveling in a direction substantially perpendicular to a longitudinal axis of the handle; and biasing said blade locking mechanism, wherein when said blade is moved between a closed position with a blade cutting edge positioned within said handle cavity and said extended position of use, said tang becomes directly positioned between said anvil and said stop pin in substantially the same longitudinal plane and becomes compressed to prevent rotation of said blade.

18. The method of claim 17, further comprising the step of impeding the opening of said knife blade from said closed position by providing a ball detente on said knife blade and positioned proximate to said locking mechanism.

19. The method of claim 17, wherein said releasable tang is released by providing a force to a thumb ramp positioned proximately to an upper edge of said knife handle.

20. The method of claim 17, wherein said releasable tang is biased with a leaf spring which is integral to said locking mechanism.

21. A folding knife with compression locking mechanism, comprising:

a handle having a front end, a rear end and a cavity defined therebetween;

a knife blade having a front end, a heel end with an anvil, a cutting edge and an upper edge, said heel end rotatably interconnected to said front end of said handle, wherein said knife blade travels between a first extended position of use and a second closed position wherein said knife blade cutting edge is positioned substantially within said handle cavity;

a stop pin interconnected to said handle proximate to an upper edge of said handle for engaging said heel end of said blade when said blade is in said first extended position of use; and a compression locking means interconnected on at least a first end to said handle and positioned within said handle cavity, said compression locking means comprising a releasable wedge positioned directly between said anvil of said blade and said stop pin when said knife blade is in said first extended position of use and traveling in a direction that is substantially perpendicular to a longitudinal axis of the handle, wherein when pressure is applied downward on said upper edge of said blade, said releasable wedge is compressed between said blade anvil and said stop pin to prevent closure of said knife blade.

* * * * *